US005563580A

United States Patent [19]

Stephens

[11] Patent Number: 5,563,580

[45] Date of Patent: Oct. 8, 1996

[54] AQUATIC SPLASH DETECTION SYSTEM

[76] Inventor: James O. Stephens, 1521 E. Sierra St., Phoenix, Ariz. 85020

[21] Appl. No.: 527,631

[22] Filed: Sep. 12, 1995

[51] Int. Cl.[6] ..... G08B 13/183

[52] U.S. Cl. ..... 340/541; 340/522; 340/556; 340/566; 340/573

[58] Field of Search ..... 340/541, 556, 340/566, 522, 573, 540

[56] References Cited

U.S. PATENT DOCUMENTS

| | | | |
|---|---|---|---|
| 3,732,556 | 5/1973 | Caprillo et al. | 340/566 |
| 3,969,712 | 7/1976 | Butman et al. | 340/566 |
| 4,620,181 | 10/1986 | Sackett | 340/566 |
| 5,023,593 | 6/1991 | Brox | 340/522 |
| 5,049,859 | 9/1991 | Arnell | 340/573 |
| 5,255,301 | 10/1993 | Nakamura et al. | 340/556 |
| 5,268,673 | 12/1993 | Nelson et al. | 340/566 |
| 5,274,607 | 12/1993 | Bean | 367/98 |

*Primary Examiner*—Glen Swann

[57] ABSTRACT

A security system for pools and spas incorporates two distinct sections. The first control means allows for automatic operation and consists of sensors that detect and keep track of the number of adults entering or leaving the pool area and deactivate or activate the second control means of the system. Within the second control means, a motion detector first senses movement of an animate object in the area adjacent to the pool, which then interrupts, for a certain period of time, pool cleaning equipment to allow the aquatic sonic transducer to operate at a more effective sensitivity which senses frequencies characteristic of splashing over other sounds, coupled to circuitry responsive to the same frequencies. When splashing is detected, alarms are activated which then need to be reset.

6 Claims, 4 Drawing Sheets

AQUATIC SPLASH DETECTION SYSTEM

FIELD OF THE INVENTION

This invention relates to swimming pool alarms, intended to provide warning should a child or domestic animal fail into an unattended swimming pool or other aquatic pool, or in the event of use by unauthorized persons.

BACKGROUND OF THE INVENTION

Statistics show that an alarming number of children drown in private swimming pools every day. Drowning is particularly prevalent among young children who do not know how to swim, or are not capable of getting out of pools under emergency or accidental situations.

A large number of different types of swimming pool alarms have been proposed and even marketed. However, to the best of this applicant's knowledge, none of these devices have had any success due to their unacceptable large number of false alarms. A problem with the wave motion and pressure sensor type devices is the surface condition of the water being affected by wind and pool cleaning equipment. The pulsed echo type devices cannot detect objects obscured by odd shaped walls as most modern shaped pools. Regular hydrophones are simply microphones in a waterproof inclosure and react to a wide range of frequencies such as low flying aircraft, dogs barking, and other sounds external to the water, which make them unacceptable.

SUMMARY OF THE INVENTION

In view of the foregoing discussion, an object of this invention is to provide a more reliable system which is primarily intended to detect and warn of small children entering a pool of water, while allowing an automatic alarm deactivation when adults are in the pool area. Automatic operation of a security system is of extreme importance; a system not turned on is the one in which an accident occurs.

According to the invention, a first control means using sensors located at entrances to the pool area and positioned so as to detect adults and not children, automatically deactivate the second control means (motion and splash detector section) when adults enter the pool area, and activate same when adults leave the pool area. Within the first control means, a counter counts up the number of adults as they move one direction through the sensors and counts down the number of adults as they move through the sensors in the reverse direction until the count is at zero, meaning the adults are within the home and not in the pool area. At such time the count is at zero, the first control means activates a sensor (motion detector or beam brake type), such that when an object is detected moving in the area near the pool, interrupts for a period of time any noise making devices such as pool cleaning equipment, and during that time the aquatic splash detector section is activated. If while the splash detector is activated splashing is detected, an alarm or alarms are turned on.

These and other various advantages will become more apparent to those skilled in the art from the ensuing detailed description of a preferred embodiment, with reference to the accompanying drawings.

DETAILED DESCRIPTION OF THE INVENTION

Figure 1:
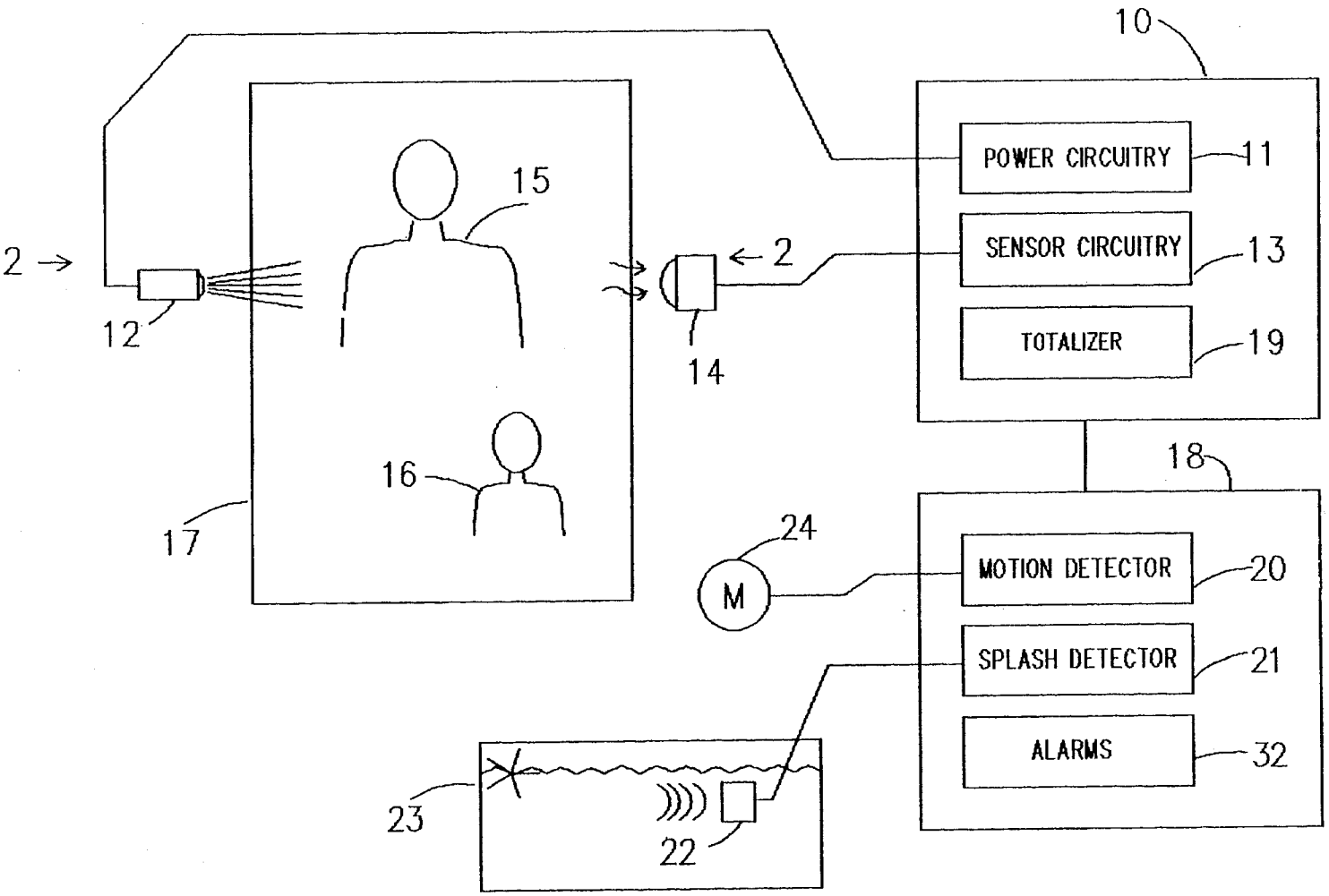
FIG. 1 shows the various elements of the sensors and control devices in a descending order.

FIG. 1, is a perspective view of the preferred embodiment of the present invention. A first control means 10, providing power circuitry 11 for light sources 12 and sensor circuitry 13 for light sensors 14, mounted so as to detect adults 15 (tall persons) and not children 16 as they pass through each entrance 17 to the pool area, allow automatic control by deactivating second control means 18 when an adult 15 wishes to swim.

Figure 2:
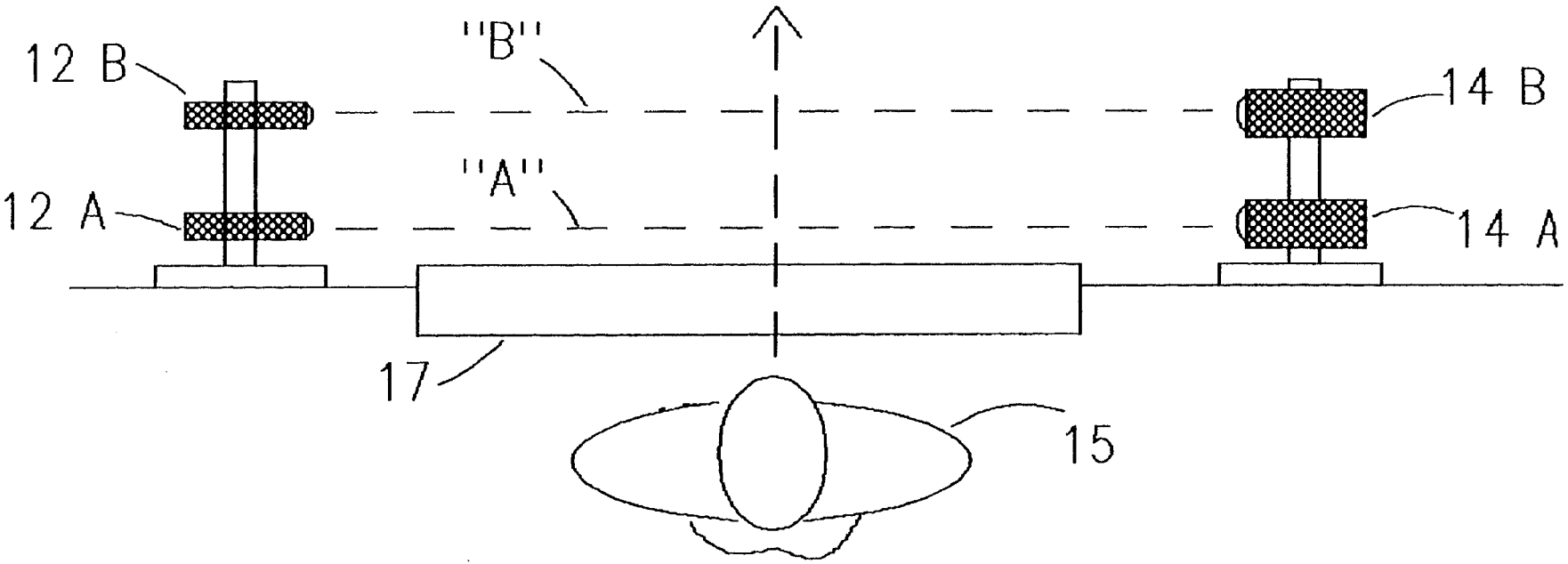
FIG. 2 is a plan perspective of the present invention, taken along line 2—2 of FIG. 1.

First control means 10 incorporates circuitry capable of counting up as (refer to FIG. 2) adults 15 moving in one direction interrupt light beams "A" and "B" between devices 12 and 14, and counting down as the reverse occurs (totalizing). When no adults 15 are in the pool area, totalizer 19 is set at zero, which activates second control means 18 (refer to FIG. 3).

Second control means 18 is a combination of a motion detector 20 of the infrared type, and a splash detector 21 connected to a unique type of vibration transducer 22 securely mounted in a pool 23. When motion detector 20 detects movement of an animate object (child or intruder), pool pump equipment 24 is interrupted for a period of time (off several minutes) during which time splash detector 21 is allowed to be on. Vibration transducer 22 senses frequencies characteristic of splashing over other sounds,coupled to splash detector 21 circuitry responsive to the same frequencies.

Figure 4:
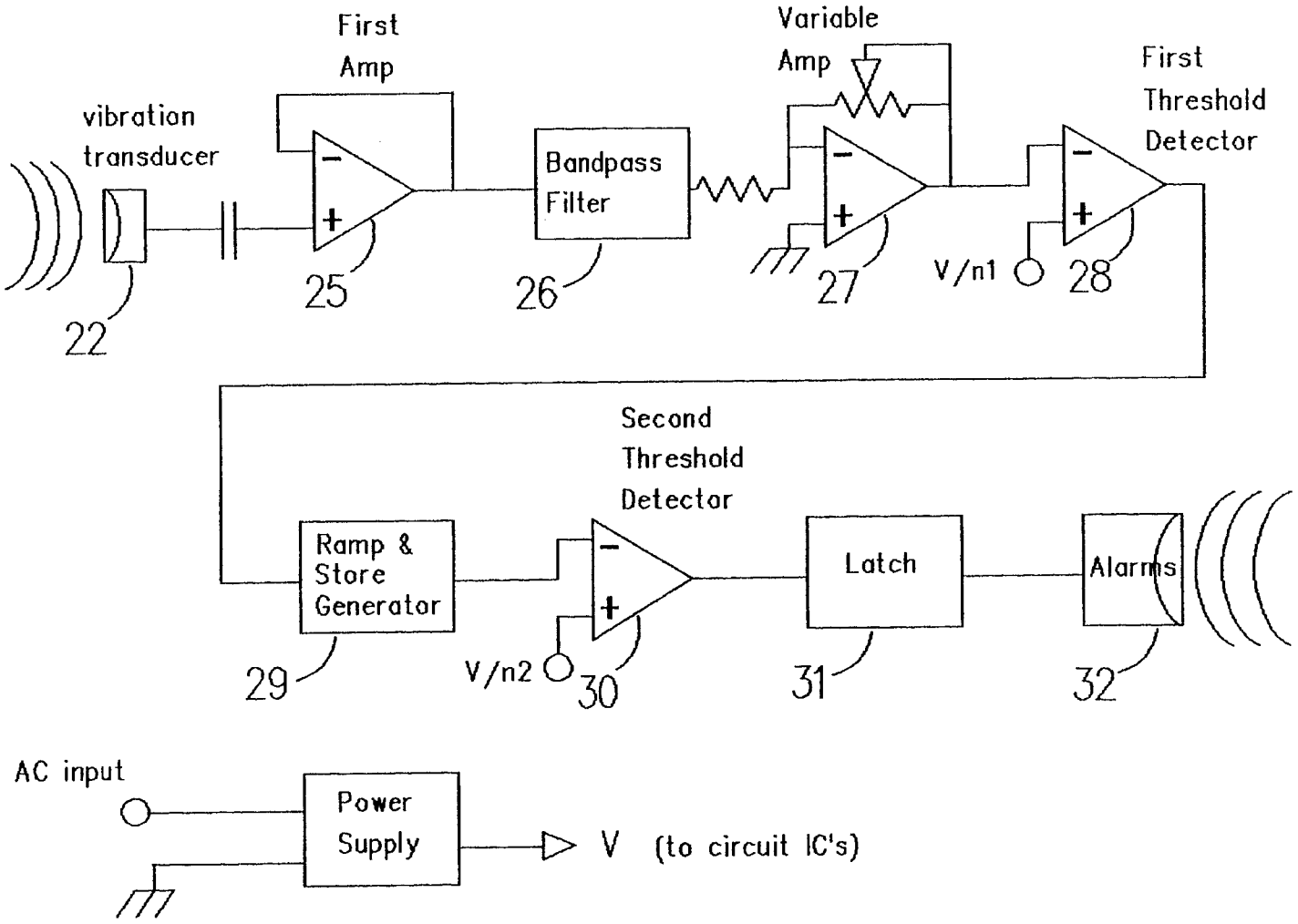
FIG. 4 shows a block diagram of the aquatic splash detector.

While splash detector 21 is on, vibrations from a splash are hydraulically transmitted to vibration transducer 22 which has a mechanical resonance of approximately 3 K Hz, producing an electrical signal coupled to first amp 25 of splash detector 21 circuitry (refer to FIG. 4). A bandpass filter 26 allows 3 K Hz to pass and blocks out most other frequencies. A variable amplifier 27 is adjusted to compensate for sensitivity differences in each vibration transducer 22. A first threshold detector 28 allows signals of predetermined amplitude to pass while a ramp and store 29 circuitry increases with each additional splash signal. An occurrence of 3 or 4 small splashes raises the stored signal above a second threshold detector 30 which turns on a latch 31 which then activates one or more alarms 32.

Figure 3:
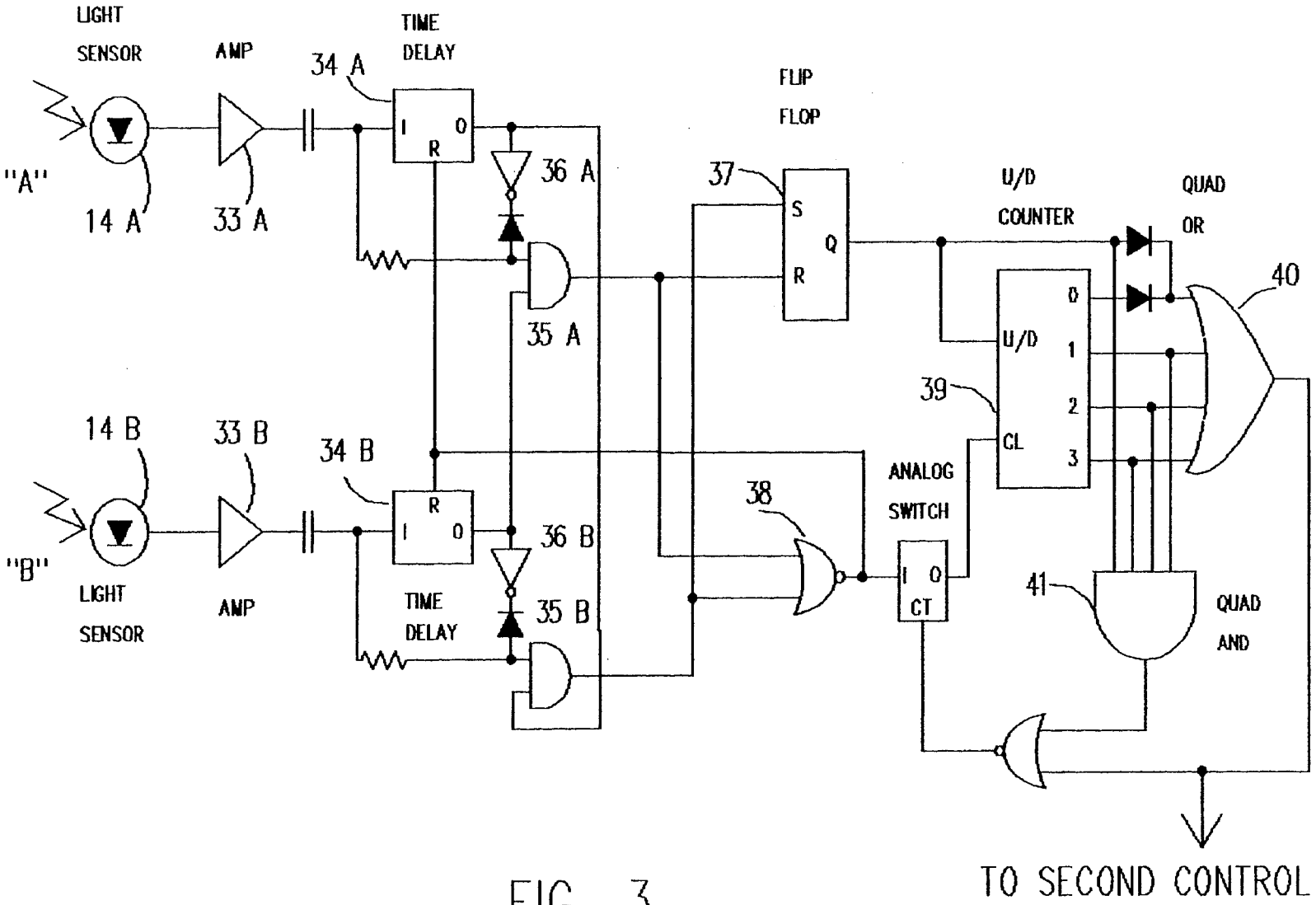
FIG. 3 shows a totalizer circuit for keeping track of adults and enabling the next sequence.

A detailed description of the operation of totalizer 19 circuit of FIG. 3 follows.

As an object first blocks light beam "A" to light sensor 14 A, amp 33 A initiates time delay 34 A and applies a pulse to one input of and gate 35 A. Output of time delay 34 A holds one input of and gate 35 B high while holding one input of and gate 35 A low through inverter 36 A with no output from and gate 35 A. As an object blocks second light beam "B" to light sensor 14 B, amp 33 B initiates time delay 34 B and applies a high pulse to one input of and gate 35 B. A pulse out of and gate 35 B causes flip flop 37 to be set with output to determine count up or down of counter 39.

And gate 35 B pulse out also causes OR gate 38 to clock counter 39 and to reset both time delay 34 A & 34 B.

Quad OR gate 40 prevents counter 39 from counting down from zero and quad AND gate 41 prevents counter 39 from counting greater than 15.

Channel A is a mirror of channel B and therefore has the inverse affect when an object first blocks light beam "B" then light beam "A".

The alarm circuitry could be designed to automatically activate an emergency system such as dialing police or private security service in case of intrusion.

The signal from motion detector 20 could be transmitted through the power lines to a receiving device to interrupt pool cleaning equipment 24 instead of being hard wired.

An alternate warning system would be to have the alarm activated by the motion detector 20, thus eliminating vibration transducer 22 and splash detector 21 although not as error free.

Yet another alternative would be to replace motion detector 20 with a low power microwave detector or infrared beam break system.

Although the invention has been specifically described in terms of specific embodiments, other alternatives, variations, and modifications are embraced within the spirit and broad scope of the appended claims.

I claim:

1. A security system providing automatic control, said system comprising in combination:

(a) a sensor means to detect tall persons passing through an entrance and producing signals therefrom (b) a means to totalize said signals and with a preset total, activate a detection means (c) said detection means in response to intrusion detection, activating an alarm.

2. The security system of claim 1, wherein each entrance to a specified area has said sensor means.

3. The security system of claim 1, wherein said detection means deactivates for a period of time, any noise making devices and during said time, activates a means to detect and distinguish vibrations in a liquid medium, output of said means activating alarms.

4. The security system of claim 3, said means to detect vibrations in a liquid medium being a device which has a mechanical resonance of approximately 3 K Hz, producing an electrical signal coupled to circuitry responsive to 3 K Hz.

5. A means to detect the number of tall persons passing through an entrance, wherein said means upon acquiring a preset total, activates a detection means which when detecting movement of an animate body, deactivates for a period of time, noise making devices while during same said time, activates a means to detect and distinguish vibrations in a liquid medium, output of said means activating alarms.

6. An aquatic pool alarm system comprising a first and a second control means to provide automatic operation by said first control means detecting and totalizing tall persons in a pool area and activating said second control means when no tall persons are in said pool area, said second control means then detecting animate movement in said pool area, and thereupon interrupting noise making devices and activating a circuit and transducer which are frequency responsive to splashing, said splashing when detected activating a latch which turns on alarms.

* * * * *